United States Patent [19]

George

[11] Patent Number: 4,941,209

[45] Date of Patent: Jul. 17, 1990

[54] UNITARY GARMENT

[76] Inventor: Rosemary J. George, 9008 Beverly Hill, Houston, Tex. 77063

[21] Appl. No.: 292,320

[22] Filed: Dec. 30, 1988

[51] Int. Cl.[5] ..... A41D 13/02

[52] U.S. Cl. ..... 2/79; 2/77

[58] Field of Search ..... 2/79, 77, 78 B, 78 R

[56] References Cited

U.S. PATENT DOCUMENTS

| | | | |
|---|---|---|---|
| 1,806,430 | 5/1931 | Traynor | 2/77 |
| 2,357,532 | 9/1944 | Menzin | 2/79 |
| 3,088,116 | 5/1963 | Simonoff | 2/78 |
| 3,852,824 | 12/1974 | Grey | 2/79 |
| 3,852,842 | 12/1974 | Gray | 2/79 |
| 3,949,427 | 4/1976 | Sampey | 2/79 |
| 3,994,026 | 11/1976 | Sampey | 2/79 |
| 4,457,025 | 7/1984 | Meryash | 2/79 |

FOREIGN PATENT DOCUMENTS

| | | | |
|---|---|---|---|
| 610252 | 10/1960 | Italy | 2/77 |

*Primary Examiner*—Werner H. Schroeder
*Assistant Examiner*—Sara M. Current
*Attorney, Agent, or Firm*—Arnold, White & Durkee

[57] ABSTRACT

This invention relates to a unitary garment which includes an upper and lower portion. The upper and lower portions of the unitary garment are configured to fit the top and bottom of a human torso respectively. The lower portion further includes a detachable drop-seat panel which is fastened along its side edges toward the front of the unitary garment and in the pocket area. The unitary garment further includes two pockets associated with the lower portion such that the pockets are configured to substantially conceal the fastening means and resulting fastened side edges of the drop-seat panel.

20 Claims, 3 Drawing Sheets

FIG.1
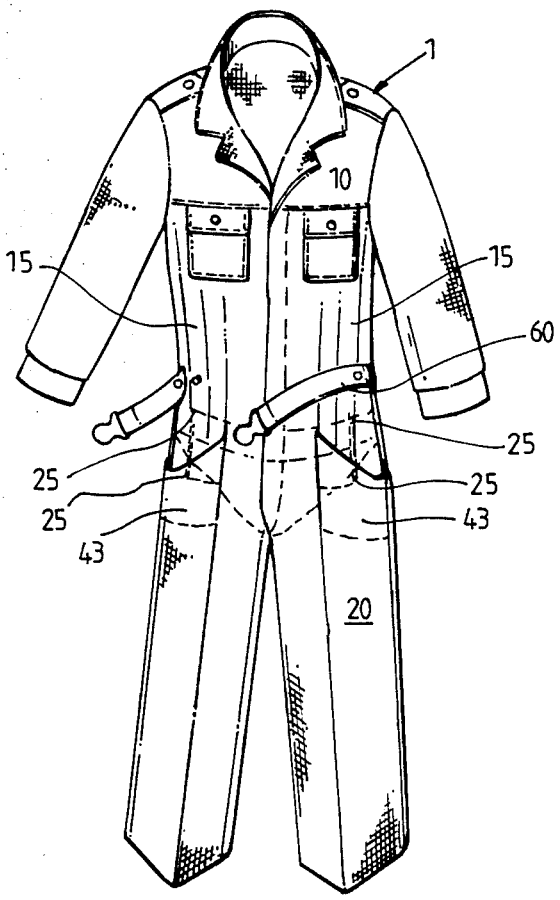
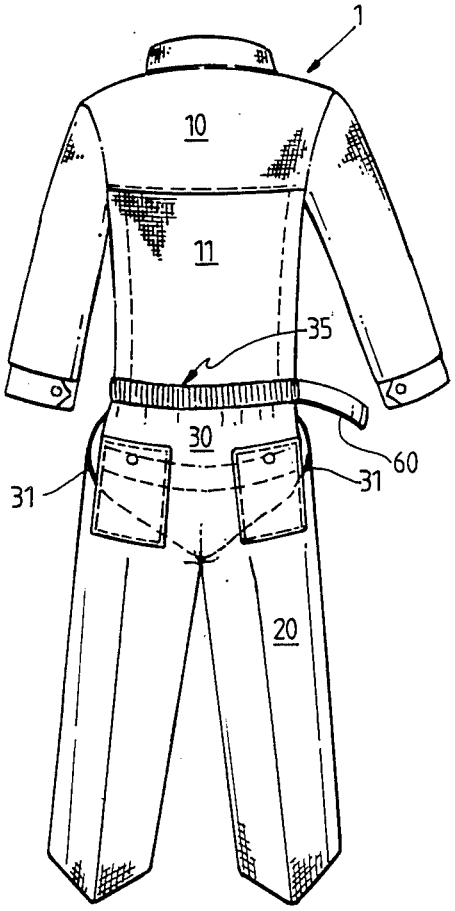
FIG.2
FIG.3
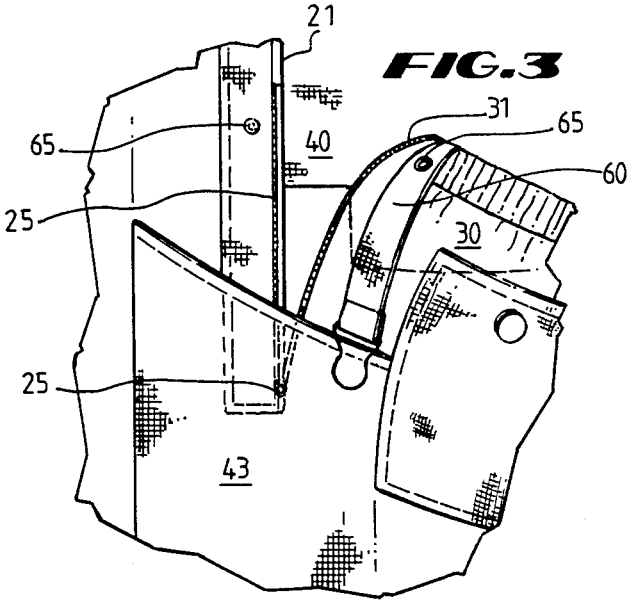
FIG.4
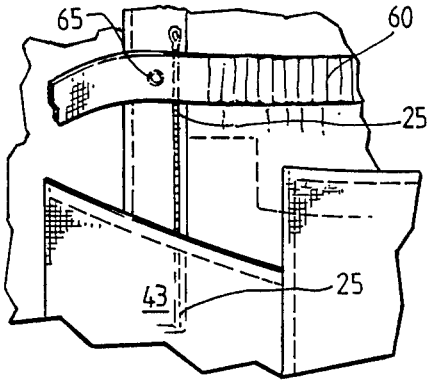

FIG.8
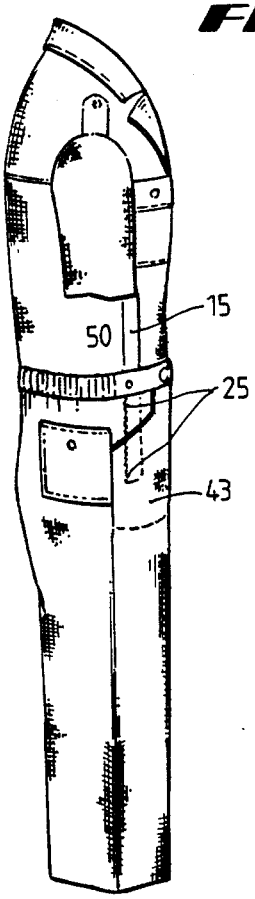
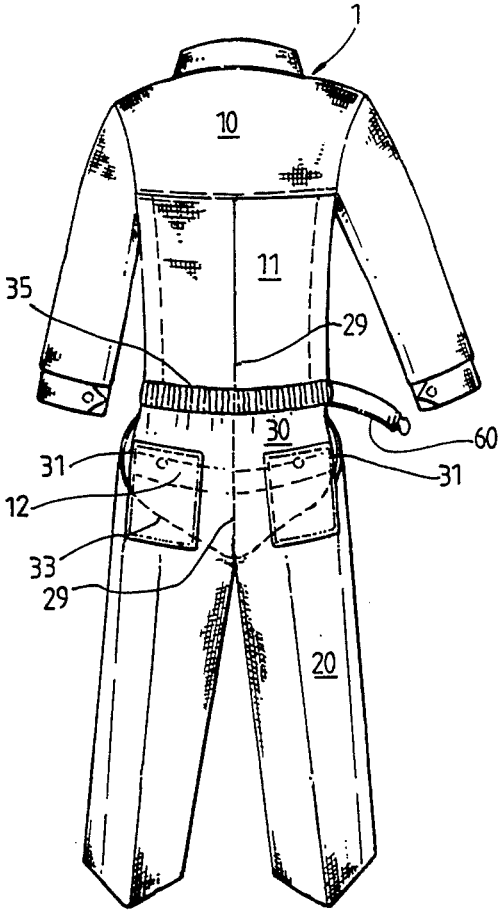
FIG.10
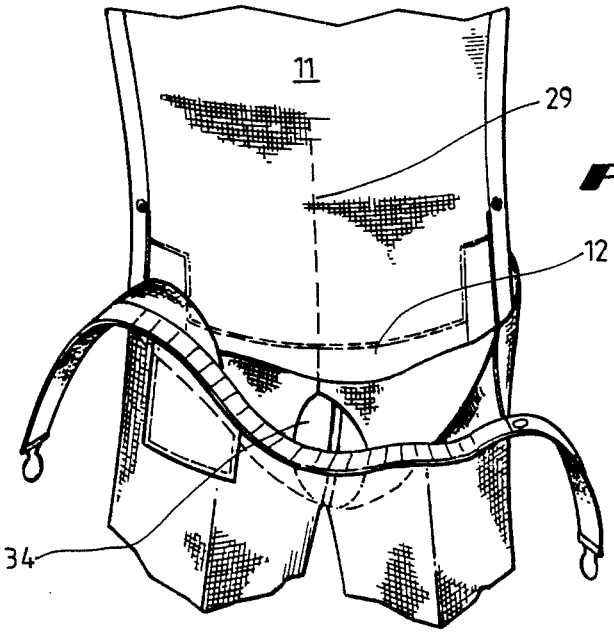
FIG.9

UNITARY GARMENT

BACKGROUND OF THE INVENTION

1. Field of the Invention

This invention relates to an improved unitary garment, particularly a unitary garment having a novel drop-seat panel to permit restroom facility usage.

2. Description of Related Art

Numerous drop-seat designs have been proposed and patented. See for example U.S. Pat. No. 3,088,116 to Simonoff (1963), U.S. Pat. No. 3,852,824 to Grey (1974), U.S. Pat. Nos. 3,949,427 and 3,994,026 to Sampey (1976), and U.S. Pat. No. 4,457,025 to Meryash (1984). However, none of the previous designs contemplate discreet placement of fasteners toward the front of the unitary garment and in the pocket area. Nor was the additional support and practicality of a lining contemplated.

SUMMARY OF THE INVENTION

Generally, the present invention provides an improved unitary garment having upper and lower portions configured to enclose the upper and lower human torso respectively and at least the upper portion of the legs where each of said upper and lower portions include a front and a back panel. The unitary garment includes a drop-seat panel in the lower portion, said drop-seat panel being permanently joined at its bottom edge to the back panel of said lower portion. The drop-seat panel is configured to attach along its sides to the unitary garment such that closure occurs along the front of the garment in the area of the front pockets. The upper edge of the drop-seat panel can be further secured to the garment by means of belts and elastic.

The novel drop-seat design of the present invention features fasteners which are placed away from the side, toward center front, and preferably extending downward into the pockets located in the lower front panel of the unitary garment. This gives the wearer more security of privacy should fastening means fail and also results in a unitary garment which is attractive, comfortable and adaptable to every mode of use.

Both the upper and lower portions of the unitary garment can take a variety of configurations including long sleeve, short sleeve, long pants, short pants, and coulottes. The garment itself can also be structured for a variety of functions such as but not limited to: work suit, child's play suit, adult sport wear, medical garment, formal garment and foul weather gear. If desired the unitary garment will have a lining and may also incorporate built-in briefs which may be detached at the crotch area. The briefs may also be configured to be pulled out and washed separately.

BRIEF DESCRIPTION OF THE DRAWINGS

Reference to the following detailed description will clarify the present invention and should be taken in conjunction with the accompanying drawings in which:

FIG. 1 is a front perspective view of one embodiment of the unitary garment of this invention.

FIG. 2 is a back perspective view of the embodiment shown in FIG. 1.

FIG. 3 is an expanded view of the fastening means in relation to the pocket area with the drop-seat panel in its open configuration according to one embodiment of the invention.

FIG. 4 is an expanded view of the fastening means in relation to the pocket area with the drop-seat panel in its closed configuration according to the embodiment in FIG. 3.

FIG. 8 is a side perspective view of the embodiment shown in FIG. 1.

FIG. 9 is a back perspective view of one embodiment of the unitary garment of this invention showing the drop-seat in its open configuration.

FIG. 10 is a back perspective view of a preferred embodiment of the present invention showing the relationship between the back, tuck panel and inner lining.

DESCRIPTION OF THE PREFERRED EMBODIMENTS

Figure 5:
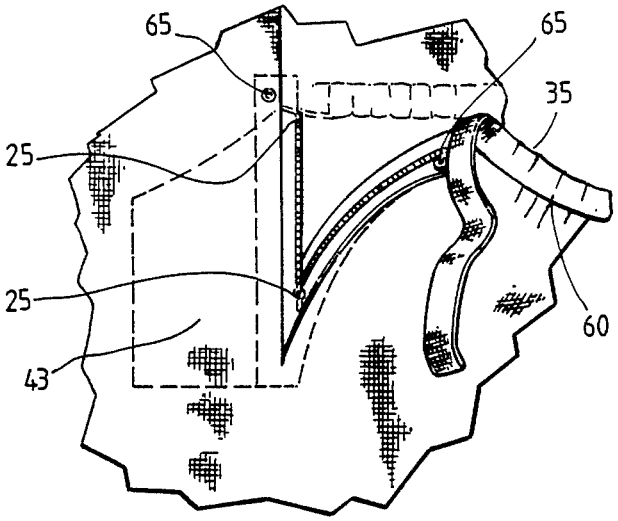
FIG. 5 is an expanded view of the fastening means in relation to the pocket area with the drop-seat panel in its open configuration according to a second embodiment of the invention.

FIGS. 1 and 2 illustrate a unitary body garment 1 having upper portion 10 configured to fit the top of a human torso and lower portion 20 likewise configured to fit the bottom of a human torso and at least the upper portion of the legs. The lower portion 20 further includes a detachable panel 30 (referred to as a drop-seat panel) and pockets 43 which are configured to conceal or partially conceal fastening means 25 which secure side edges 31 of drop-seat panel 30 to the front panel of lower portion 20. Hence, the resulting fastened side edges 31 are effectively concealed by their position relative to their respective pocket 43. Belting means 60 may be used to further secure the upper edge 35 of drop-seat 30 to the back panel 11 of upper portion 10. In a preferred embodiment, belting means 60 are associated with attachment means 65 which are secured near the top of fastening means 25.

In FIG. 3, the drop-seat panel 30 is shown partially detached from the unitary garment 1 such that drop-seat opening 40 and tuck panel 12 (FIG. 9) may permit restroom usage without removing the entire upper portion of the garment. In the preferred embodiment of this invention, drop-seat panel 30 is detachably connected to the front edges 21 of lower portion 20 along its side edges 31 by fastening means 25. Fastening means 25 are usually positioned in the area of the front pockets 43 such that each pocket conceals a substantial portion of the connection (see FIG. 4). The edges 21 and 31 may be secured by a variety of fastening means, all of which are known in the industry, such as zippers, "Velcro" pressure sensitive fasteners, buttons, hooks and snaps. The fastening means 25 are intentionally put in the area of the front pockets in order to afford concealment, accessibility and additional security should the fastening means fail, hence providing greater peace of mind for the wearer.

Figure 6:
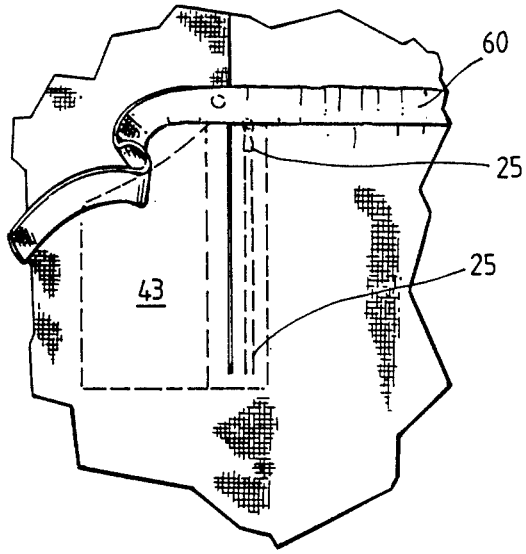
FIG. 6 is an expanded view of the fastening means in relation to the pocket area with the drop-seat panel in its closed configuration according to the embodiment of FIG. 5.
Figure 7:
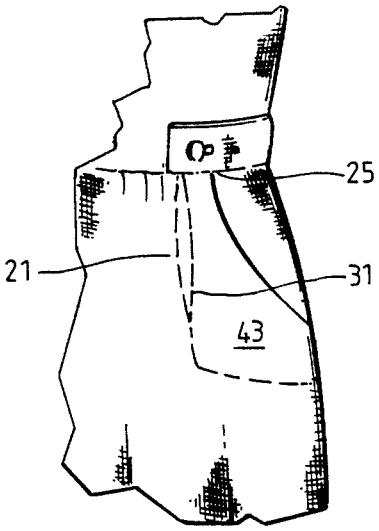
FIG. 7 is an expanded view of the fastening means in relation to the pocket area in a third embodiment of the invention.

The pockets 43 have both the traditional function of providing storage space and the invention-specific function of concealing or partially concealing attachment means 25 and resulting fastened side edges 31 (see e.g., FIGS. 4, 6 and 7). Placement of the fastening means 25 in the pocket area obviates the need for side seams, resulting in greater freedom of movement for the wearer and a better garment fit. Although not needed, some embodiments of the invention do have partial or noncontinuous side seams. In the embodiment of the invention that contains no side seams (see FIG. 8), side panels 50 extend from the bottom edge of the pockets 43 to the underarm of the garment which continues to form the undersleeve of the garment. These panels give shape, reinforce, eliminate bulk, and decrease the likelihood of underarm rips. Some embodiments of the invention feature vertical bands 15 that also conceal or partially conceal fastening means 25. The vertical bands 15 extend upward on the unitary garment to create both a fashionable appearance and a convenient means of storing pens and pencils.

In an alternate embodiment of this invention (see FIGS. 5 and 6), the openings of the pockets 43 are vertically positioned in which case it is less desirable to place the fastening means 25 inside the pockets 43. In such an embodiment, the fastening means 25 are placed immediately adjacent to the pockets 43. In another embodiment of this invention (see FIG. 7), the edges 21 and 31 are left partially open to facilitate detachment of the drop-seat panel. In this embodiment, fastening means 25 such as buttons, "Velcro" pressure sensitive fasteners, or skirt-type hooks are placed at the top inner edge of each pocket 43 to hold the pocket in position and to support the drop-seat panel 30.

In the most preferred embodiment, the upper edge 35 of the drop-seat panel 30 is not directly attached to the unitary garment 1. Belting means 60 extend from either end of the upper edge 35 such that the belting means 60 wrap around the lower torso and secure in the front. In some embodiments the upper edge 35 of the drop-seat panel 30 is integrally constructed with an elastic or stretching means familiar to those knowledgeable in the industry such that when the belting means are secure, the upper edge 35 of the drop-seat panel 30 expands and draws snug against the lower torso.

Attachment means 65 may consist of "Velcro" pressure sensitive fasteners, snaps, buttons or hooks and are placed on each arm of the belting means 60 such that each of said arms can be secured to the unitary body garment 1 at a single point. The preferred placement of attachment means 65 is at a point near the top of the junction of edges 21 and 31 which are connected by fastening means 25. The combination of attachment means 65 and fastening means 25 securely close the drop-seat panel 30 and form a perfect seal against drafts and exposure.

In FIG. 9, the back panel 11 of the upper portion 10 of the unitary garment 1 is cut such that it extends below the upper edge 35 of the drop-seat panel 30 when in the attached or closed position. This tuck panel 12 may hang freely from the back of the garment or may be secured along its bottom edge to an inner lining. When a lining is not used (FIGS. 9–10), a center back seam 29 is used in the mid-portion of back 11 and tuck panel 12. Tuck panel 12 is extended downward to a point which covers the derriere. The seam 29 is left open to form opening 34 (FIG. 9) in tuck panel 12 from below the waist line area its bottom edge. The lower opening 34 of seam 29 may be secured by a fastener such as "Velcro" or a snap.

One embodiment to the invention features an inner lining. For more elegant garments that have fine outer material, the lining is a full lining consisting of arms, torso, briefs and legs; in simpler garments the lining may only be a set of briefs. When the lining consists only of a set of briefs, the upper rear edge of the briefs may be secured to the lower edge of the tuck panel 12 and may include a separable center seam which forms an opening 34 when separated during restroom usage. The front edge of the briefs may be detachably secured at a point in the front of the garment in the crotch area. In a preferred embodiment, a lining is attached to the lower portion of tuck panel 12 which extends beyond the crotch inseam and detaches in front of the garment. The lining is lapped at the center back sufficiently for opening 34 to remain closed while the wearer engages in normal activities, and can be readily opened for restroom usage. This lining ensures that tuck panel 12 remains securely tucked in and gives excellent support to the entire lower portion of the unitary garment.

It is understood that additional embodiments may be included within the scope of the present invention detailed above, therefore it is to be understood that the details set forth above are to be interpreted as illustrative and not in a limiting sense.

What is claimed is:

1. A unitary garment comprising:

a. an upper portion having a front panel and a back panel adapted to enclose the upper portion of a human torso;

b. a lower portion having a front panel and a back panel and adapted to enclose the lower portion of a human torso and at least the upper portion of the legs, the front panel of said upper portion being integral with the front panel of said lower portion;

c. a separate side pocket along each side of the front panel of said lower portion proximate the upper portion;

d. a drop-seat panel having a bottom edge permanently joined to the back panel of said lower portion, a top edge, and two side edges, each side edge configured to be in a position proximate the side pocket on its respective side of the garment when the drop-seat panel is in its closed position; and e. a separate fastener associated with each side pocket adapted to fasten the side edge of the drop-seat panel proximate its respective side pocket to the front panel of said lower portion of the garment wherein closure occurs along the front of said garment in the area of the side pocket and such that the resulting fastened side edge is effectively concealed by its position relative to its respective side pocket.

2. A unitary garment according to claim 1 wherein each said fastener is placed substantially within its respective said pocket.

3. A unitary garment according to claim 1 wherein each said fastener is placed immediately adjacent to its respective said pocket.

4. A unitary garment according to claim 1 wherein each said fastener is a zipper, pressure-sensitive fastener, button, snap or hook.

5. A unitary garment according to claim 1 which includes a belt to detachably join the upper edge of said drop-seat panel to the unitary garment.

6. A unitary garment according to claim 5 further comprising pressure-sensitive fasteners, snaps, buttons or hooks for attaching the belt to the unitary garment.

7. A unitary garment according to claim 1 including vertical bands in the upper portion extending upward from each side pocket which are configured to further conceal the fastened side edges.

8. A unitary garment according to claim 1 which further includes one or more tuck panels attached to the back panel of the upper portion of said unitary garment wherein said tuck panels are configured to extend below the upper edge of said drop-seat panel.

9. A unitary garment according to claim 8 wherein said tuck panel comprises a shirt tail attached to the back panel of the upper portion of the unitary garment.

10. A unitary garment according to claim 1 which is seamless along each side and includes two opposed panels, each side panel extending from the bottom end of its respective side to an underarm of the unitary garment and beyond to form an undersleeve of the unitary garment.

11. A unitary garment according to claim 1 which includes partial or non-continuous side seams.

12. A unitary garment according to claim 1 wherein the upper portion further comprises a pair of sleeves and the bottom portion further comprises a pair of pants.

13. A unitary garment according to claim 1 which includes a full lining consisting of arms, torso, briefs and legs.

14. A unitary garment according to claim 1 which includes a lining consisting of a set of briefs secured to a front panel of the garment in the crotch area.

15. A unitary garment comprising:

a. an upper portion having a front panel and a back panel adapted to enclose the upper portion of a human torso;

b. a lower portion having a front panel and a back panel and adapted to enclose the lower portion of a human torso and at least the upper portion of the legs, the front panel of said upper portion being integral with the front panel of said lower portion;

c. a separate side pocket along each side of the front panel of said lower portion proximate the upper portion;

d. a drop-seat panel having a bottom edge permanently joined to the back panel of said lower portion, a top edge, and two side edges, each side edge configured to be in a position proximate the side pocket on its respective side of the garment when the drop-seat panel is in its closed position; and e. a separate fastener associated with each side pocket adapted to fasten the side edge of the drop-seat panel proximate its respective side pocket to the front panel of said lower portion of the garment wherein each said fastener extends downward into its respective pocket located in the lower front panel and such that the resulting fastened side edge is effectively concealed by its position relative to its respective side pocket.

16. A unitary garment according to claim 15 wherein each fastener is a zipper, pressure-sensitive fastener, button, snap or hook.

17. A unitary garment comprising:

a. an upper portion having a front panel and a back panel adapted to enclose the upper portion of a human torso;

b. a lower portion having a front panel and a back panel and adapted to enclose the lower portion of a human torso and at least the upper portion of the legs, the front panel of said upper portion being integral with the front panel of said lower portion;

c. a separate side pocket along each side of the front panel of said lower portion proximate the upper portion;

d. a drop-seat panel having a bottom edge permanently adjoined to the back panel of said lower portion, a top edge, and two side edges, each side edge configured to be in a position proximate the side pocket on its respective side of the garment when the drop-seat panel is in its closed position; and e. a separate fastener associated with each side pocket adapted to fasten the side edge of the drop-seat panel proximate its respective side pocket to the front panel of said lower portion of the garment wherein each said fastener is placed immediately adjacent to its respective side pocket located in the lower front panel and such that the resulting fastened side edge is effectively concealed by its position relative to its respective side pocket.

18. A unitary garment according to claim 17 wherein each fastener is a zipper, pressure-sensitive fastener, button, snap or hook.

19. A unitary garment comprising:

a. an upper portion having a front panel and a back panel adapted to enclose the upper portion of a human torso;

b. a lower portion having a front panel and a back panel and adapted to enclose the lower portion of a human torso and at least the upper portion of the legs, the front panel of said upper portion being integral with the front panel of said lower portion;

c. a separate side pocket along each side of the front panel of said lower portion proximate the upper portion;

d. a drop-seat panel having a bottom edge permanently joined to the back panel of said lower portion, a top edge, and two side edges, each side edge configured to be in a position proximate the side pocket on its respective side of the garment when the drop-seat panel is in its closed position;

e. a separate fastener associated with each side pocket adapted to fasten the side edge of the drop-seat panel, proximate its respective side pocket to the front panel of said lower portion of the garment wherein closure occurs along the front of said garment in the area of the side pocket and such that the resulting fastened side edge is effectively concealed by its position relative to its respective side pocket;

f. a tuck panel attached to the back panel of the upper portion which continues below the upper portion and defines a brief including a separable center seam, said brief being detachably secured proximate the crotch area in the front panel of the lower portion.

20. A unitary garment according to claim 19 including vertical bands in the upper portion extending upward from each side pocket which are configured to further conceal the fastened side edges.

* * * * *